US008020837B2

(12) United States Patent
Byrne, Jr.

(10) Patent No.: US 8,020,837 B2
(45) Date of Patent: Sep. 20, 2011

(54) SPLASH BAR

(75) Inventor: Thomas Jerome Byrne, Jr., Jamestown, NC (US)

(73) Assignee: Evapco, Inc., Westminster, MD (US)

( * ) Notice: Subject to any disclaimer, the term of this patent is extended or adjusted under 35 U.S.C. 154(b) by 925 days.

(21) Appl. No.: 11/971,594

(22) Filed: Jan. 9, 2008

(65) Prior Publication Data

US 2009/0174090 A1 Jul. 9, 2009

(51) Int. Cl.
*B01F 3/04* (2006.01)

(52) U.S. Cl. .. 261/111; 261/113; 261/117; 261/DIG. 11

(58) Field of Classification Search ..... 261/94, 261/111, 113, 117, DIG. 11
See application file for complete search history.

(56) References Cited

U.S. PATENT DOCUMENTS 5,185,105 A 2/1993 Peterson
7,618,026 B2 * 11/2009 Armstrong ..... 261/111

* cited by examiner

*Primary Examiner* — Robert A Hopkins
(74) *Attorney, Agent, or Firm* — Rader, Fishman & Grauer PLLC; Carl Schaukowitch

(57) ABSTRACT

A splash bar includes a tubular splash bar body in a form of a lattice structure that has a plurality of openings formed therethrough. The splash bar body is positioned centrally along and about an imaginary three-dimensional coordinate system having a lengthwise axis defining a lengthwise direction, a widthwise axis defining a widthwise direction and a heightwise axis defining a heightwise direction with the lengthwise axis, the widthwise axis and the heightwise axis being oriented perpendicularly relative to one another. The splash bar body defines a hollow passageway extending in the lengthwise direction and has a top portion, a bottom portion disposed generally opposite the top portion and a pair of opposing side portions interconnecting respective ones of the bottom and top portions with the top and bottom portions spanning the opposing side portions. The top portion is generally upwardly arcuate in shape as viewed in cross-section.

18 Claims, 11 Drawing Sheets

SPLASH BAR

FIELD OF THE INVENTION

The present invention relates to a splash bar. More particularly, the present invention is directed to a splash bar adapted for use in a cooling tower.

BACKGROUND OF THE INVENTION

Cooling towers of various types and sizes are well known in the art. Some cooling towers are a cross-flow type whereby cooling air flows crosswise relative to downwardly-raining heated water. Other cooling towers are a counter-flow type whereby cooling air flows diametric to the downwardly-raining heated water. Some cooling towers, regardless of their type, are constructed in a manufacturing plant and shipped to the required location for installation while other cooling towers, particularly large ones, are erected in the field at the required location.

A prior art cooling tower 2 is illustrated by way of example in FIG. 1. A hanger grid 4 is supported inside the cooling tower 2. The hanger grid 4 includes a plurality of vertical hanger support members 6 attached at an upper portion of the cooling tower 2 and a plurality of horizontal hanger support members 8 that are connected to the vertical hanger support members to form a matrix of splash bar compartments 10 for receiving individual ones of the splash bars 12. Typically, individual ones of the splash bars 12 are horizontally inserted into alternating vertical and horizontal ones of the splash bar compartments 10 as shown in FIG. 1.

During cooling operations, the heated water HW rains downwardly from the upper portion of the cooling tower and contacts the splash bars 12. As is well known in the art, the splash bars 12 function to "break up" the downwardly-raining heated water HW, preferably into small water droplets, to enhance the cooling effect of the cross-flowing air or the counter-flowing air.

From the prior art cooling tower 2, one of the prior art splash bars 12 is illustrated in FIGS. 2-4. In FIG. 2, note that the horizontal hanger support members 8 are spaced apart at a horizontal spacing distance Dhs so that the prior art splash bar 12 can rest thereon and therebetween while the vertical hanger supports 6 are space apart at a vertical spacing distance Dvs which is sufficient to receive the prior art splash bar 12 therebetween. Typically, the vertical spacing distance Dvs is slightly larger than 4 inches while a width Wsb of the prior art splash bar is less than the vertical spacing distance Dvs or approximately 4 inches. As best illustrated in FIG. 3, the prior art splash bar 12 has a generally rectangular shape as viewed in cross-section. As viewed in FIG. 4, the prior art splash bar 12 rests on and between the horizontal hanger support members 8 that are spaced apart from one another at the Dhs of approximately 24 inches. This 24-inch spacing is sufficient for the prior art splash bars 12 to withstand the force of the raining-down heated water HW as the raining-down heated water HW contacts the splash bars 12 for a reasonable useful life.

However, when horizontal spacing distance Dhs between the horizontal hanger support members was increased to above the 24-inch spacing, the generally rectangularly-shaped splash bars 12 sagged along its longitudinally-extending length under the force of the raining-down heated water HW and subsequently lost effectiveness in "breaking up" the raining-down heated water HW.

The inventors desired to extend the horizontal spacing distance Dhs between the horizontal support members 8 but without making significant structural or material changes to the prior art splash bars 12 while maintaining effectiveness of the splash bars for a reasonable useful life.

It would be beneficial to provide a splash bar for insertion in its splash bar compartment with the horizontal hanger support members being spaced apart from one another at a horizontal spacing distance greater than 24 inches to save installation time and material cost. It would be beneficial to provide a splash bar with sufficient strength so that it can be inserted in its splash bar compartment with the horizontal hanger support members being spaced apart from one another at a horizontal spacing distance of greater than 24 inches, such as approximately 60 inches, and function effectively during cooling operations without sagging along the longitudinally-extending length of the splash bar. The present invention provides these benefits.

OBJECTS AND SUMMARY OF THE INVENTION

It is an object of the invention to provide a splash bar for insertion in its splash bar compartment with the horizontal hanger support members being spaced apart from one another at a distance greater than 24 inches.

It is an another object of the invention to provide a splash bar with sufficient strength so that it can be inserted in its splash bar compartment with the horizontal hanger support members being spaced apart from one another at a distance greater than 24 inches, and particularly at a distance of approximately 60 inches, and function effectively during cooling operations without sag along the longitudinally-extending length of the splash bar.

Accordingly, a splash bar of the present invention is hereinafter described. The splash bar of the present invention includes a tubular splash bar body in a form of a lattice structure that has a plurality of openings formed therethrough. The splash bar body is positioned centrally along and about an imaginary three-dimensional coordinate system having a lengthwise axis defining a lengthwise direction, a widthwise axis defining a widthwise direction and a heightwise axis defining a heightwise direction with the lengthwise axis, the widthwise axis and the heightwise axis being oriented perpendicularly relative to one another. The splash bar body defines a hollow passageway extending in the lengthwise direction and has a top portion, a bottom portion disposed generally opposite the top portion and a pair of opposing side portions interconnecting respective ones of the bottom and top portions with the top and bottom portions spanning the opposing side portions. The top portion is generally upwardly arcuate in shape as viewed in cross-section.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Figure 1:
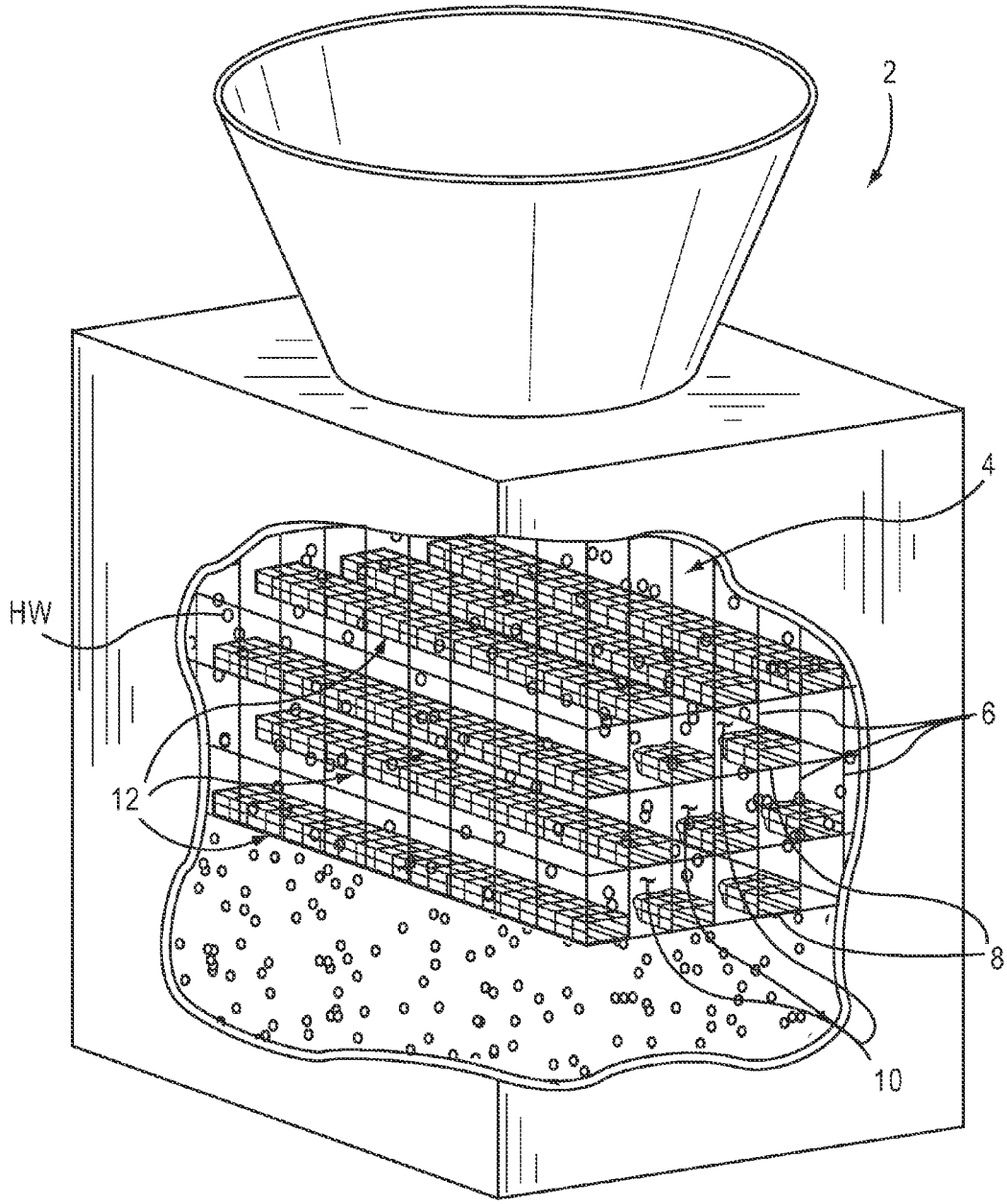
FIG.1 PRIOR ART
FIG. 1 is a perspective view shown partially broken away of a conventional cooling tower having a hanger grid defining a matrix of splash bar compartments.
Figure 2:
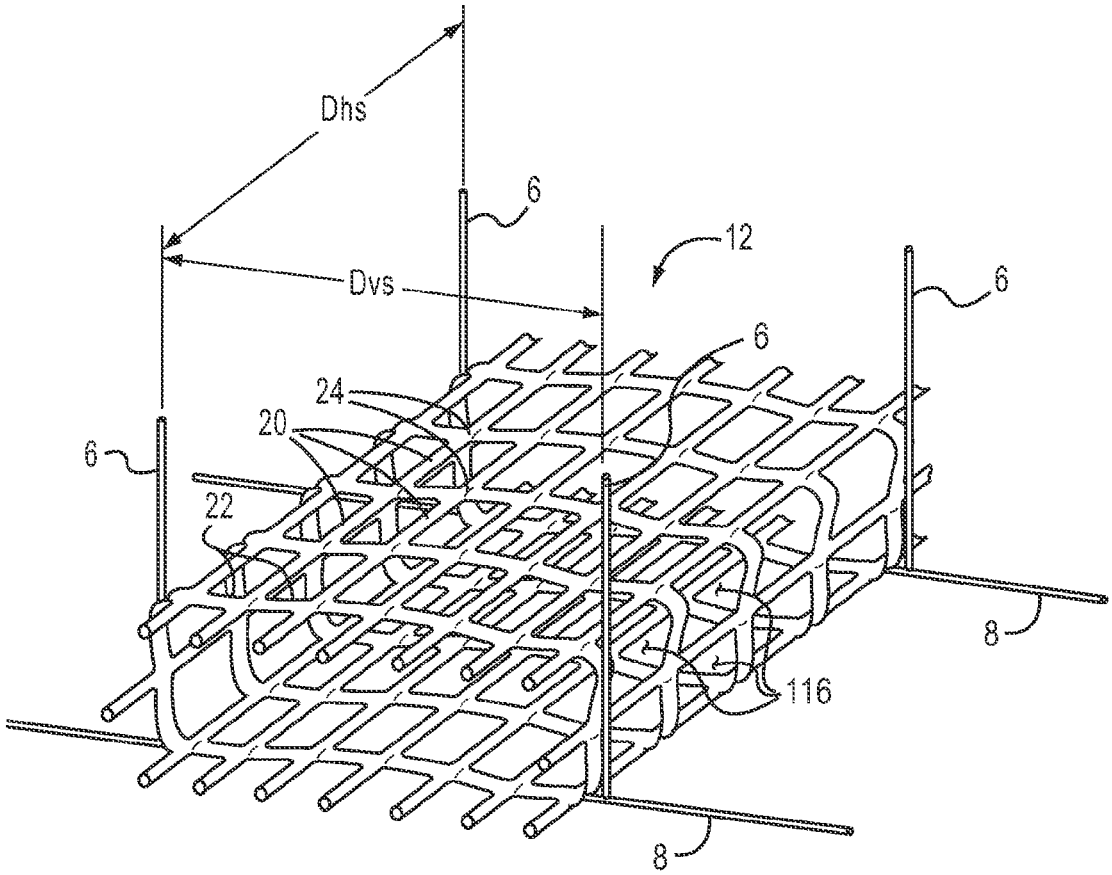
FIG.2 PRIOR ART
FIG. 2 is a perspective view of a conventional splash bar disposed in one of the splash bar compartments shown in FIG. 1.
Figure 3:
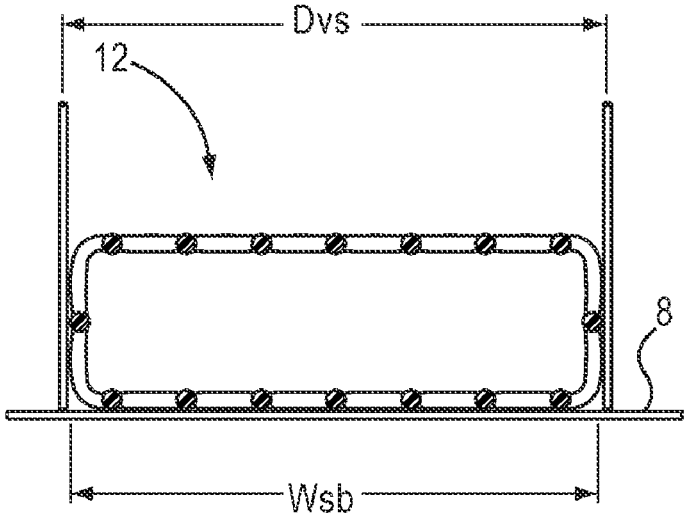
FIG.3 PRIOR ART
FIG. 3 is a cross-sectional view of the conventional splash bar taken along line 3-3 in FIG. 4.
Figure 4:
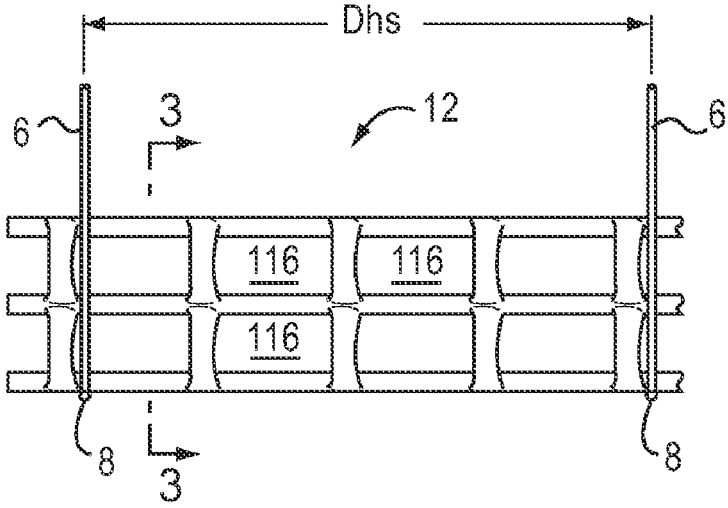
FIG.4 PRIOR ART
FIG. 4 is a side elevational view of the conventional splash bar shown in FIGS. 2 and 3.

Hereinafter, exemplary embodiments of the present invention will be described with reference to the attached drawings. The structural components common to those of the prior art and the structural components common to respective embodiments of the present invention will be represented by the same symbols and/or reference numbers and repeated description thereof will be omitted.

Furthermore, for ease of understanding the present invention only, directional terms such as "upwardly", "downwardly" and terms related to the orientation of the components such as "top", "bottom" and like are used herein and may be associated to how the components of the present invention are presented on the drawing figures. However, these directional and orientational terms should not be construed as limiting the scope the invention because, one of ordinary skill in the art could simply substitute non-directional or non-descriptive terms such as "first", "second" and the like and fully comprehend the scope of the present invention.

A first exemplary embodiment of a splash bar 112 of the present invention is hereinafter described with reference to FIGS. 5-7. The splash bar 112 includes a tubular splash bar body 114 that is in a form of a lattice structure. The splash bar body 114 in its form of the lattice structure has a plurality of openings 116 formed therethrough.

Figure 5:
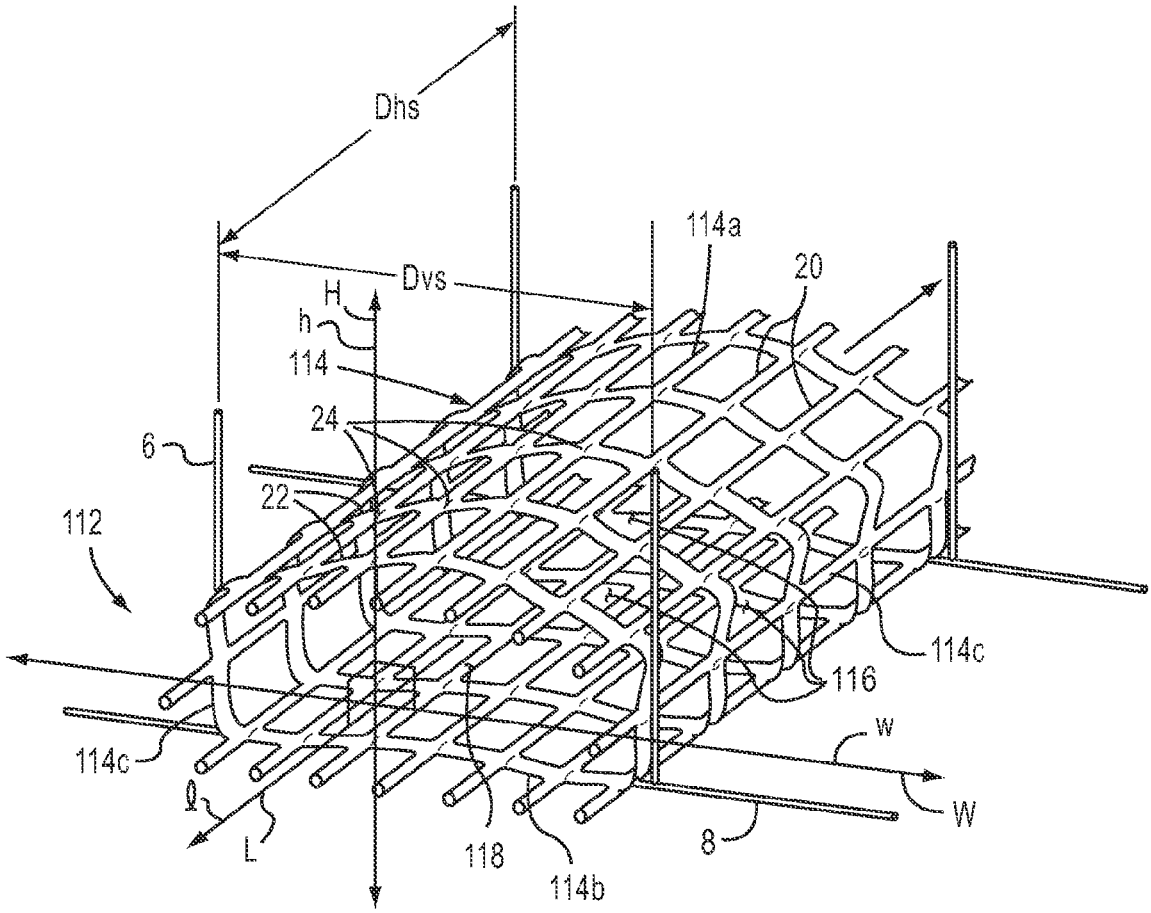
FIG. 5 is a perspective view of a first exemplary embodiment of a splash bar of the present invention disposed in a splash bar compartment.

For description purposes and as best illustrated in FIG. 5, the splash bar body 112 is positioned centrally along and about an imaginary three-dimensional coordinate system having a lengthwise axis L defining a lengthwise direction I, a widthwise axis W defining a widthwise direction w and a heightwise axis H defining a heightwise direction h. As commonly known in a three-dimensional coordinate system, the lengthwise axis L, the widthwise axis W and the heightwise axis H are oriented perpendicularly relative to one another as shown in FIG. 5.

Figure 6:
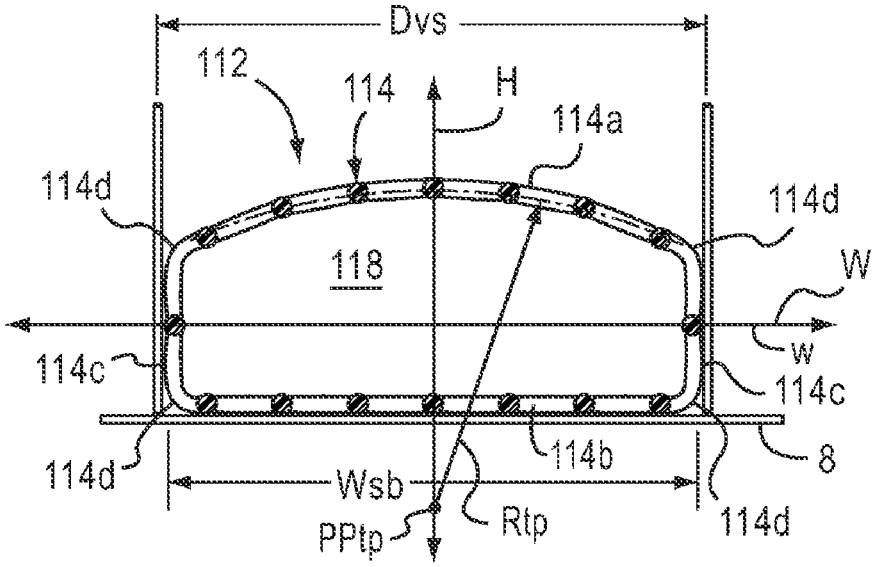
FIG. 6 is a cross-sectional view of the splash bar taken along line 6-6 in FIG. 7.

In FIGS. 5 and 6, the splash bar body 114 defines a hollow passageway 118 that extends in the lengthwise direction I. Also, the splash bar body 114 has a top portion 114*a*, a bottom portion 114*b* disposed generally opposite the top portion 114*a* and a pair of opposing side portions 114*c*. The pair of opposing side portions 114*c* interconnects respective ones of the top and bottom portions 114*a* and 114*b* respectively such that the top and bottom portions 114*a* and 114*b* respectively span the opposing side portions 114*c*.

As best shown in FIGS. 5 and 6, the top portion 114*a* is generally upwardly arcuate in shape as viewed in cross-section. That is, the generally upwardly arcuate top portion 114*a* projects away from the widthwise axis W as the top portion 114*a* spans from respective ones of the opposing side portions 114*c* towards the centrally-disposed heightwise axis H. The term "generally" is discussed in more detail hereinbelow. The term "upwardly" is used to describe the direction of the arcuate shape and is deemed opposite to the "downwardly-raining" hot water HW shown in FIG. 1.

With reference to FIG. 6, the top portion 114*a* is generally upwardly arcuate based upon a top portion radius Rtp of curvature. Note that the top portion radius Rtp of curvature commences at a top portion radius pivot point PPtp that is disposed on the heightwise axis H below the widthwise axis W and extends to the top portion 114*a*. Further, the bottom portion 114*b* is generally flat as viewed in cross-section in FIG. 6. Additionally, respective ones of the pair of opposing side portions 114*c* and 114*c* extend generally parallel to one another as viewed in cross-section and generally perpendicularly to the widthwise axis W. However, where the top portion 114*a* and the bottom portion 114*b* connect to the respective ends of the pair of opposing side portions 114*c* and 114*c*, curved portions 114*d* form these connections. The width Wsb of the first embodiment of the splash bar 112 is substantially the same as that of the prior art.

Figure 7:
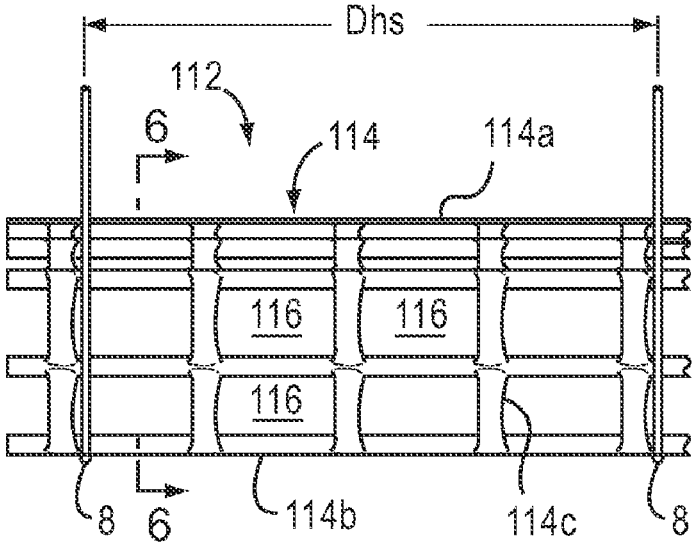
FIG. 7 is a side elevational view of the splash bar shown in FIGS. 5 and 6.

As viewed in FIGS. 5-7, the vertical spacing distance Dvs is the same as in the prior art. However, the first embodiment of the splash bar 112 of the present invention having generally upwardly arcuate in shape as viewed in cross-section enables the horizontal spacing distance Dhs to be greater than 24 inches and up to approximately 60 inches.

Figure 8:
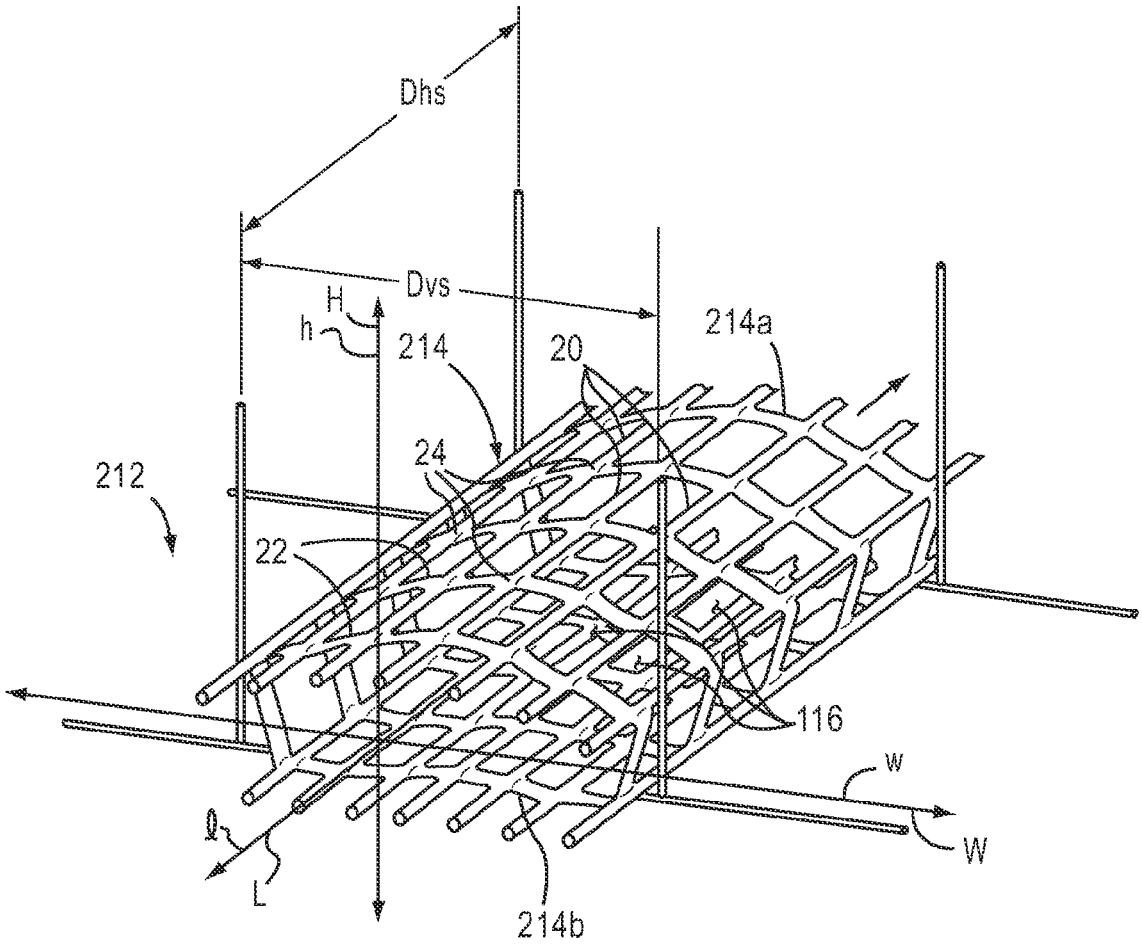
FIG. 8 is a perspective view of a second exemplary embodiment of the splash bar of the present invention disposed in a splash bar compartment.
Figure 9:
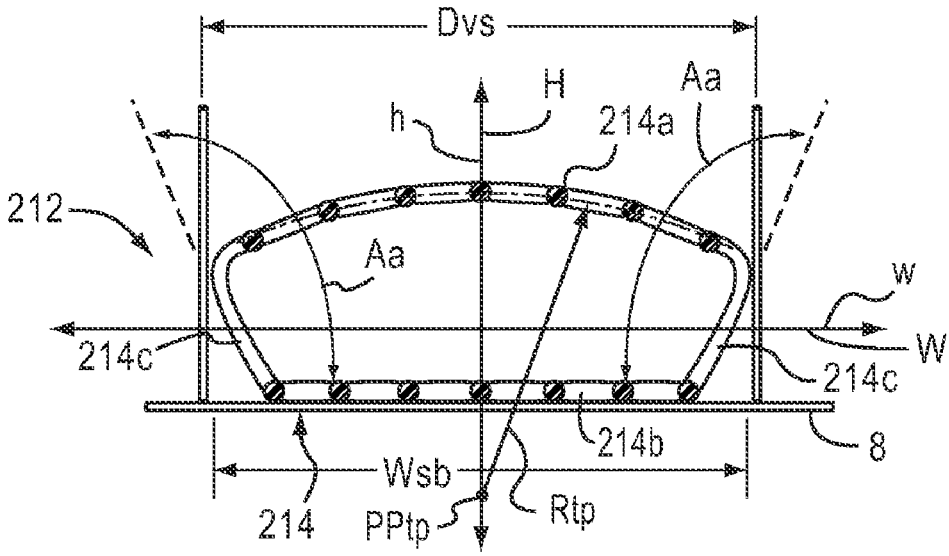
FIG. 9 is a cross-sectional view of the splash bar taken along line 9-9 in FIG. 10.
Figure 10:
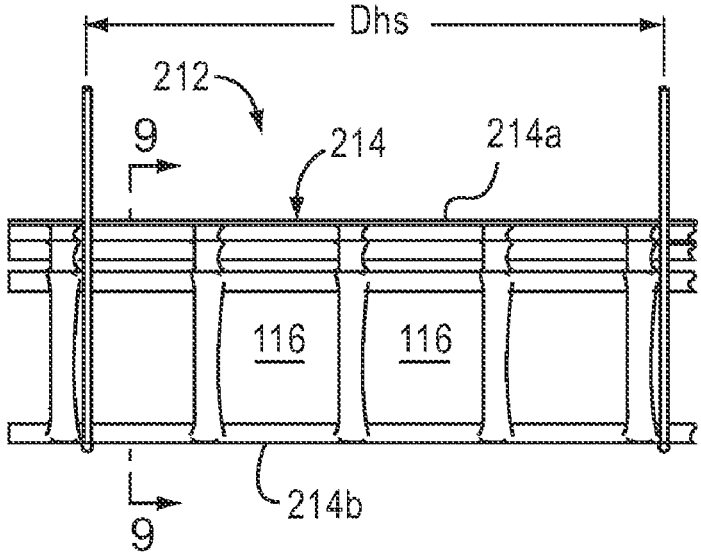
FIG. 10 is a side elevational view of the splash bar shown in FIGS. 8 and 9.

A second exemplary embodiment of a splash bar 212 of the present invention is introduced in FIGS. 8-10. The second exemplary embodiment of the splash bar 212 is similar to the first exemplary embodiment of the splash bar 112 except for the opposing side portions. As a shown in FIG. 9, respective ones of opposing side portions 214*c* commence at a bottom portion 214*b* and extend outwardly in the widthwise direction w away from the heightwise axis H and the lengthwise axis L and upwardly in the heightwise direction h at an obtuse angle Ao relative to the bottom portion 214*b* to terminate at the top portion 214*a*.

Figure 11:
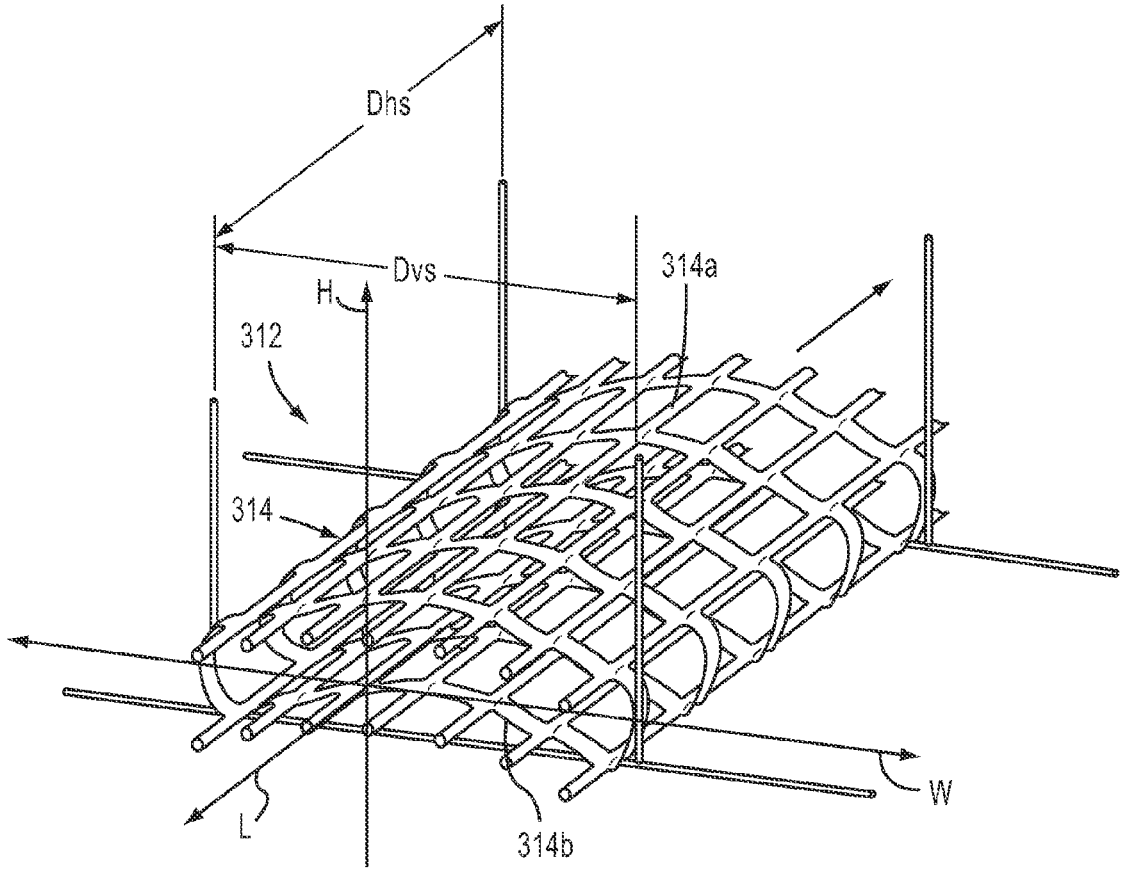
FIG. 11 is a perspective view of a third exemplary embodiment of the splash bar of the present invention disposed in a splash bar compartment.
Figure 12:
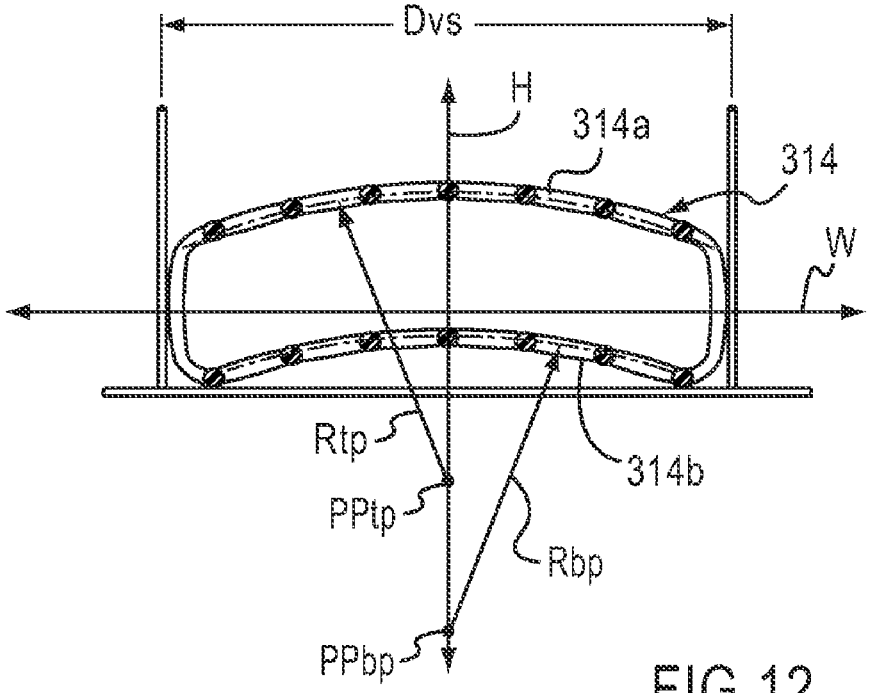
FIG. 12 is a cross-sectional view of the splash bar taken along line 12-12 in FIG. 13.
Figure 13:
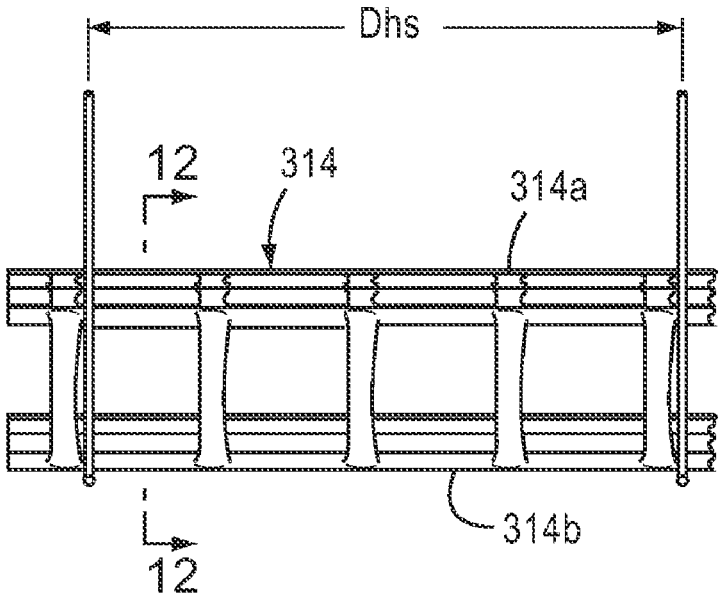
FIG. 13 is a side elevational view of the splash bar shown in FIGS. 11 and 12.

A third exemplary embodiment of a splash bar 312 of the present invention is introduced in FIGS. 11-13. The third exemplary embodiment of the splash bar 312 is similar to the first exemplary embodiment of the splash bar 112 except for the bottom portion of the splash bar body. More specifically, a bottom portion 314*b* of a splash bar body 314 is generally arcuate in shape as viewed in cross-section as best shown in FIG. 12. Note that the bottom portion 314*b* is generally upwardly arcuate based upon a bottom portion radius Rbp of curvature. The bottom portion radius Rbp of curvature commences at a bottom portion radius pivot point PPbp on the heightwise axis H below the widthwise axis W and extends to the bottom portion 314*b*. For the third exemplary embodiment of the splash bar 312 of the present invention, the top portion radius Rtp of curvature and the bottom portion radius Rbp of curvature are at least substantially equal to each other.

Figure 14:
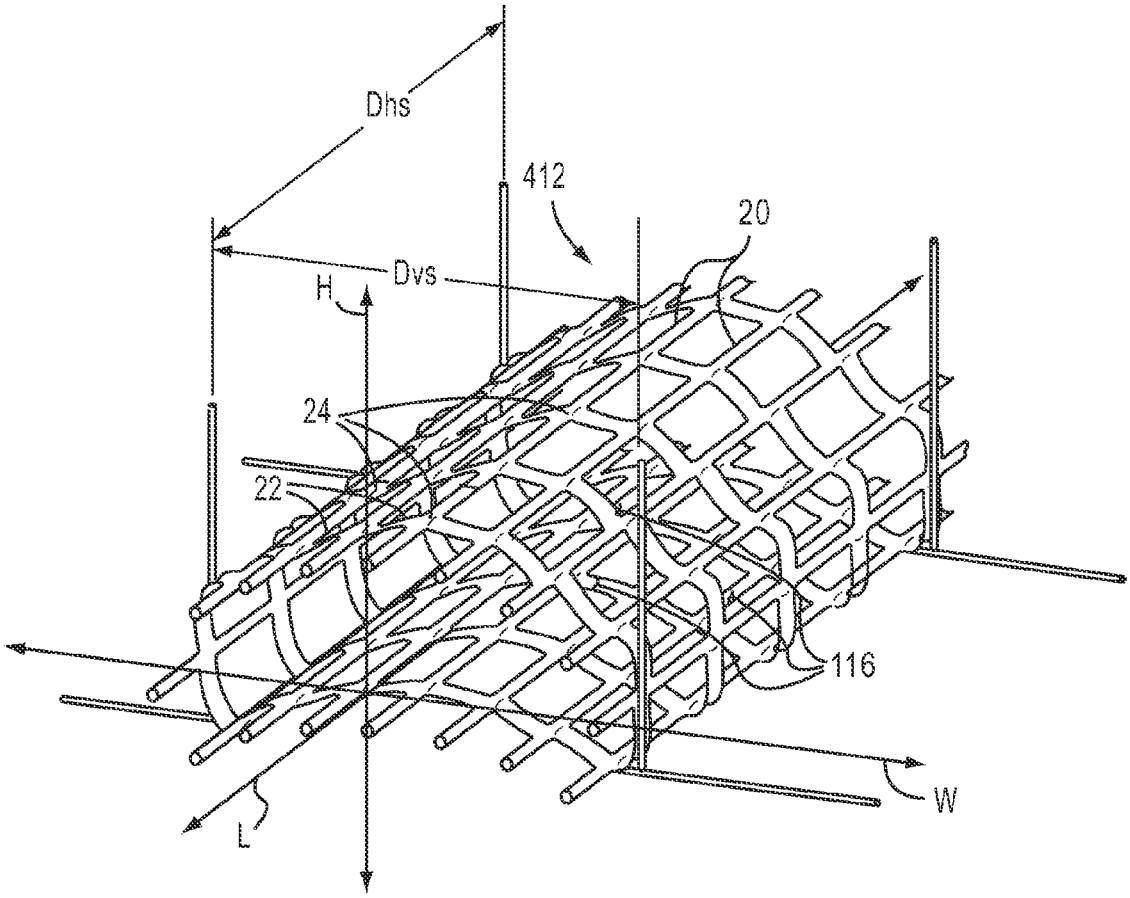
FIG. 14 is a perspective view of a fourth exemplary embodiment of the splash bar of the present invention disposed in a splash bar compartment.
Figure 15:
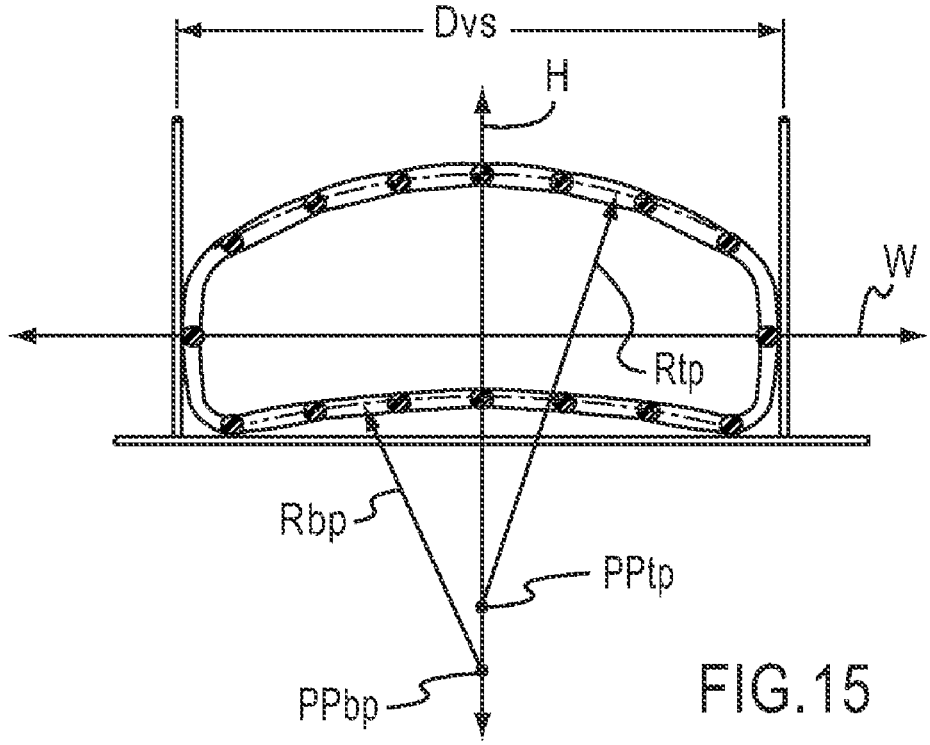
FIG. 15 is a cross-sectional view of the splash bar taken along line 15-15 in FIG. 16.
Figure 16:
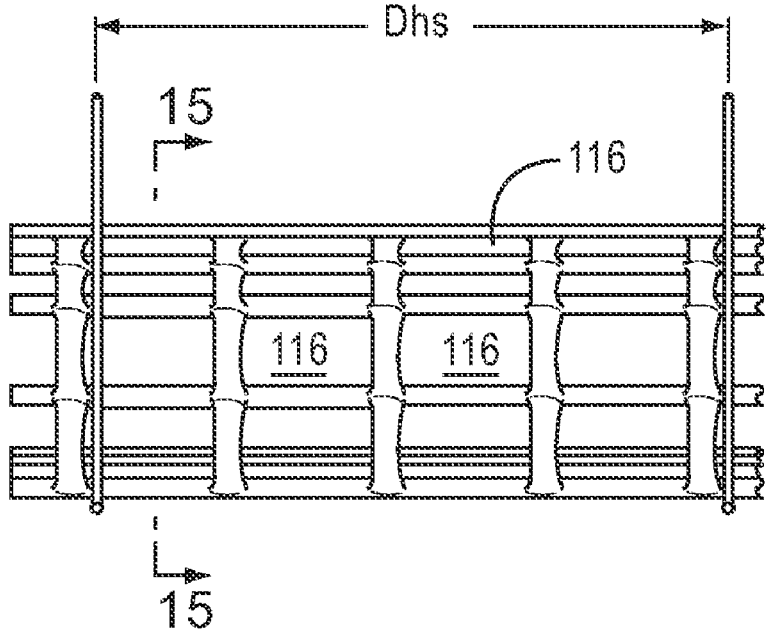
FIG. 16 is a side elevational view of the splash bar shown in FIGS. 14 and 15.

A fourth exemplary embodiment of a splash bar 412 of the present invention is introduced in FIGS. 14-16. The fourth exemplary embodiment of the splash bar 412 is similar to the third exemplary embodiment of the splash bar 312 except for the top portion and bottom portion radii of curvature. More specifically, the top portion radius Rtp of curvature and the bottom portion radius Rbp of curvature are different from one another. In this embodiment, although not by way of limitation, the top portion radius Rtp of curvature is less than the bottom portion radius Rbp of curvature.

By example only and not by way of limitation, the splash bar body of each exemplary embodiment discussed above is constructed of a plurality of first strands of material 20 and a plurality of second strands of material 22. Respective ones of the plurality of first strands of material 20 and the plurality of second strands of material 22 crisscross one another at respective intersections 24 to form the lattice structure. One of ordinary skill in the art will appreciate that the lattice structure is an integral construction with the plurality of first strands of material 20 being spaced apart from one another and extending in the lengthwise direction I and with the plurality of second strands of material 22 being spaced apart from one another and extending generally perpendicularly to and circumferentially about the plurality of first strands of material 20 thereby forming a plurality of generally rectangularly-shaped openings 116. Further, although not by way of limitation, the splash bar body of each exemplary embodiment discussed herein is fabricated from a resin material including but not limited to high density polyethelyene.

The term "generally" is used throughout the detailed description of the exemplary embodiments of the present invention to most accurately describe the invention. Since the splash bar body is constructed from a plurality of first strands of material and a plurality of second strands of material that crisscross one another at respective intersections as an integral construction, it is appreciated that first stand segments and second strand segments are connected to each other at the intersections to define respective ones of the openings. As viewed in cross-section, a skilled artisan would appreciate that the arcuate shape of the top wall or, when applicable, the bottom wall, might comprise a plurality of straight or substantially straight strand segments. Therefore, it might not be possible to form a perfect arc (shown as dashed lines in the drawing figures) from the plurality of straight strand segments. Further, a skilled artisan would comprehend that it would be desirable to make the strand segments as arcuate as possible. As a result, the arcuate shape of the top portion or the bottom portion is considered a "generally" arcuate shape and is illustrated as such in the drawing figures to encompass "straight", "substantially straight" and "arcuate" strand segments.

Accordingly, each of the exemplary embodiments of the splash bar of the present invention is adapted for insertion in a splash bar compartment with the horizontal hanger support members being spaced apart from one another at a distance greater than 24 inches. The exemplary embodiments of the splash bar of the present invention have sufficient strength so that they can be inserted into their respective splash bar compartments with the horizontal hanger support members being spaced apart from one another at a distance greater than 24 inches, and particularly up to approximately 60 inches, and function effectively during cooling operations without sagging along its longitudinally-extending length.

The present invention, may, however, be embodied in various different forms and should not be construed as limited to the exemplary embodiments set forth herein. For instance, by example only and not by way of limitation, the splash bar body might be a conventional tube having a plurality of openings formed therethrough. These exemplary embodiments are provided so that this disclosure will be thorough and complete and will fully convey the scope of the present invention to those skilled in the art.

What is claimed is:

1. A splash bar, comprising:

a tubular splash bar body in a form of a lattice structure having a plurality of openings formed therethrough, the splash bar body positioned centrally along and about an imaginary three-dimensional coordinate system having a lengthwise axis defining a lengthwise direction, a widthwise axis defining a widthwise direction and a heightwise axis defining a heightwise direction with the lengthwise axis, the widthwise axis and the heightwise axis being oriented perpendicularly relative to one another, the splash bar body defining a hollow passageway extending therethrough in the lengthwise direction, the splash bar body having a top portion, a bottom portion disposed generally opposite the top portion and a pair of opposing side portions interconnecting respective ones of the bottom and top portions with the top and bottom portions spanning the opposing side portions, wherein the top portion is generally upwardly arcuate in shape as viewed in cross-section and wherein respective ones of the pair of opposing side portions move away from each other as the pair of opposing side portions extend from the bottom portion to the top portion.

2. A splash bar according to claim 1, wherein the top portion is generally upwardly arcuate based upon a top portion radius of curvature, the top portion radius of curvature commences at a top portion radius pivot point on the heightwise axis below the widthwise axis and extends to the top portion.

3. A splash bar according to claim 1, wherein the bottom portion is generally arcuate in shape as viewed in cross-section.

4. A splash bar according to claim 3, wherein the bottom portion is generally upwardly arcuate based upon a bottom portion radius of curvature, the bottom portion radius of curvature commencing at a bottom portion radius pivot point on the heightwise axis below the widthwise axis and extends to the bottom portion.

5. A splash bar according to claim 1, wherein the splash bar body includes a plurality of first strands of material and a plurality of second strands of material crisscrossing one another at respective intersections to form the lattice structure of an integral construction with the plurality of first strands of material being spaced apart from one another and extending in the lengthwise direction and with the plurality of second strands of material being spaced apart from one another and extending generally perpendicularly to and circumferentially about the plurality of first strands of material thereby forming a plurality of generally rectangularly-shaped openings.

6. A splash bar according to claim 1, wherein the splash bar body is fabricated from a resin material.

7. A splash bar, comprising:

a tubular splash bar body in a form of a lattice structure having a plurality of openings formed therethrough, the splash bar body positioned centrally along and about an imaginary three-dimensional coordinate system having a lengthwise axis defining a lengthwise direction, a widthwise axis defining a widthwise direction and a heightwise axis defining a heightwise direction with the lengthwise axis, the widthwise axis and the heightwise axis being oriented perpendicularly relative to one another, the splash bar body defining a hollow passageway extending therethrough in the lengthwise direction, the splash bar body having a top portion, a bottom portion disposed generally opposite the top portion and a pair of opposing side portions interconnecting respective ones of the bottom and top portions with the top and bottom portions spanning the opposing side portions, wherein the top portion is generally upwardly arcuate in shape as viewed in cross-section, and wherein the bottom portion is generally flat as viewed in cross-section.

8. A splash bar, comprising:

a tubular splash bar body in a form of a lattice structure having a plurality of openings formed therethrough, the splash bar body positioned centrally along and about an imaginary three-dimensional coordinate system having a lengthwise axis defining a lengthwise direction, a widthwise axis defining a widthwise direction and a heightwise axis defining a heightwise direction with the lengthwise axis, the widthwise axis and the heightwise axis being oriented perpendicularly relative to one another, the splash bar body defining a hollow passageway extending therethrough in the lengthwise direction, the splash bar body having a top portion, a bottom portion disposed generally opposite the top portion and a pair of opposing side portions interconnecting respective ones of the bottom and top portions with the top and bottom portions spanning the opposing side portions, wherein the top portion is generally upwardly arcuate in shape as viewed in cross-section, and wherein the top portion is generally upwardly arcuate in shape as viewed in cross-section and based upon a top portion radius of curvature having a top portion radius pivot point for the top portion radius of curvature disposed on the heightwise axis below the widthwise axis and the bottom portion is generally upwardly arcuate in shape as viewed in cross-section and based upon a bottom portion radius of curvature having a bottom portion radius pivot point for the bottom portion radius of curvature disposed on the heightwise axis below the widthwise axis.

9. A splash bar according to claim 8, wherein the top portion radius of curvature and the bottom portion radius of curvature are at least substantially equal to each other.

10. A splash bar according to claim 8, wherein the top portion radius of curvature and the bottom portion radius of curvature are different from one another.

11. A splash bar according to claim 10, wherein the top portion radius of curvature is less than the bottom portion radius of curvature.

12. A splash bar, comprising:

a tubular splash bar body in a form of a lattice structure having a plurality of openings formed therethrough, the splash bar body positioned centrally along and about an imaginary three-dimensional coordinate system haying a lengthwise axis defining a lengthwise direction, a widthwise axis defining a widthwise direction and a heightwise axis defining a heightwise direction with the lengthwise axis, the widthwise axis and the heightwise axis being oriented perpendicularly relative to one another, the splash bar body defining a hollow passageway extending therethrough in the lengthwise direction, the splash bar body having a top portion, a bottom portion disposed generally opposite the top portion and a pair of opposing side portions interconnecting respective ones of the bottom and top portions with the top and bottom portions spanning the opposing side portions, wherein the top portion is generally upwardly arcuate in shape as viewed in cross-section, and wherein respective ones of the opposing side portions commencing at the bottom portion extend outwardly in the widthwise direction away from the heightwise and lengthwise axes and upwardly in the heightwise direction at an obtuse angle relative to the bottom portion to terminate at the top portion.

13. A splash bar adapted for use with a cooling tower having a hanger grid supported inside the cooling tower, the hanger grid including a plurality of vertical hanger support members and a plurality of horizontal hanger support members connected to the vertical hanger support members to form a matrix of splash bar compartments, each splash bar compartment sized to receive the splash bar, the horizontal hanger support members being spaced apart from one another at an approximate range of 24 inches and 60 inches for supporting the splash bar as the splash bar rests thereon and therebetween, the splash bar comprising:

a tubular splash bar body in a form of a lattice structure having a plurality of openings formed therethrough, the splash bar body positioned centrally along and about an imaginary three-dimensional coordinate system having a lengthwise axis defining a lengthwise direction, a widthwise axis defining a widthwise direction and a heightwise axis defining a heightwise direction with the lengthwise axis, the widthwise axis and the heightwise axis being oriented perpendicularly relative to one another, the splash bar body defining a hollow passageway extending therethrough in the lengthwise direction, the splash bar body having a top portion, a bottom portion disposed generally opposite the top portion and a pair of opposing side portions interconnecting respective ones of the bottom and top portions with the top and bottom portions spanning the opposing side portions, wherein the splash bar extends in the lengthwise direction to define a splash bar length sufficient to rest on and between the spaced-apart horizontal hanger support members, wherein the top portion is generally upwardly arcuate in shape as viewed in cross-section and wherein respective ones of the pair of opposing side portions move away from each other as the pair of opposing side portions extend from the bottom portion to the top portion.

14. A splash bar according to claim 13, wherein the top portion is generally upwardly arcuate based upon a top portion radius of curvature, the top portion radius of curvature commences at a top portion radius pivot point on the heightwise axis below the widthwise axis and extends to the top portion.

15. A splash bar according to claim 13, wherein the bottom portion is generally arcuate in shape as viewed in cross-section.

16. A splash bar adapted for use with a cooling tower having a hanger grid supported inside the cooling tower, the hanger grid including a plurality of vertical hanger support members and a plurality of horizontal hanger support members connected to the vertical hanger support members to form a matrix of splash bar compartments, each splash bar compartment sized to receive the splash bar, the horizontal hanger support members being spaced apart from one another at an approximate range of 24 inches and 60 inches for supporting the splash bar as the splash bar rests thereon and therebetween, the splash bar comprising:

a tubular splash bar body in a form of a lattice structure having a plurality of openings formed therethrough, the splash bar body positioned centrally along and about an imaginary three-dimensional coordinate system having a lengthwise axis defining a lengthwise direction, a widthwise axis defining a widthwise direction and a heightwise axis defining a heightwise direction with the lengthwise axis, the widthwise axis and the heightwise axis being oriented perpendicularly relative to one another, the splash bar body defining a hollow passageway extending therethrough in the lengthwise direction, the splash bar body having a top portion, a bottom portion disposed generally opposite the top portion and a pair of opposing side portions interconnecting respective ones of the bottom and top portions with the top and bottom portions spanning the opposing side portions, wherein the splash bar extends in the lengthwise direction to define a splash bar length sufficient to rest on and between the spaced-apart horizontal hanger support members, wherein the top portion is generally upwardly arcuate in shape as viewed in cross-section, and wherein the bottom portion is generally flat as viewed in cross-section.

17. A splash bar adapted for use with a cooling tower having a hanger grid supported inside the cooling tower, the hanger grid including a plurality of vertical hanger support members and a plurality of horizontal hanger support members connected to the vertical hanger support members to form a matrix of splash bar compartments, each splash bar compartment sized to receive the splash bar, the horizontal hanger support members being spaced apart from one another at an approximate range of 24 inches and 60 inches for supporting the splash bar as the splash bar rests thereon and therebetween, the splash bar comprising:

a tubular splash bar body in a form of a lattice structure having a plurality of openings formed therethrough, the splash bar body positioned centrally along and about an imaginary three-dimensional coordinate system having a lengthwise axis defining a lengthwise direction, a widthwise axis defining a widthwise direction and a heightwise axis defining a heightwise direction with the lengthwise axis, the widthwise axis and the heightwise axis being oriented perpendicularly relative to one another, the splash bar body defining a hollow passageway extending therethrough in the lengthwise direction, the splash bar body having a top portion, a bottom portion disposed generally opposite the top portion and a pair of opposing side portions interconnecting respective ones of the bottom and top portions with the top and bottom portions spanning the opposing side portions, wherein the splash bar extends in the lengthwise direction to define a splash bar length sufficient to rest on and between the spaced-apart horizontal hanger support members, wherein the top portion is generally upwardly arcuate in shape as viewed in cross-section, and wherein the top portion is generally upwardly arcuate in shape as viewed in cross-section and based upon a top portion radius of curvature having a top portion radius pivot point for the top portion radius of curvature disposed on the heightwise axis below the widthwise axis and the bottom portion is generally upwardly arcuate in shape as viewed in cross-section and based upon a bottom portion radius of curvature having a bottom portion radius pivot point for the bottom portion radius of curvature disposed on the heightwise axis below the widthwise axis.

18. A splash bar adapted for use with a cooling tower having a hanger grid supported inside the cooling tower, the hanger grid including a plurality of vertical hanger support members and a plurality of horizontal hanger support members connected to the vertical hanger support members to form a matrix of splash bar compartments, each splash bar compartment sized to receive the splash bar, the horizontal hanger support members being spaced apart from one another at an approximate range of 24 inches and 60 inches for supporting the splash bar as the splash bar rests thereon and therebetween, the splash bar comprising:

a tubular splash bar body in a form of a lattice structure having a plurality of openings formed therethrough, the splash bar body positioned centrally along and about an imaginary three-dimensional coordinate system having a lengthwise axis defining a lengthwise direction, a widthwise axis defining a widthwise direction and a heightwise axis defining a heightwise direction with the lengthwise axis, the widthwise axis and the heightwise axis being oriented perpendicularly relative to one another, the splash bar body defining a hollow passageway extending therethrough in the lengthwise direction, the splash bar body having a top portion, a bottom portion disposed generally opposite the top portion and a pair of opposing side portions interconnecting respective ones of the bottom and top portions with the top and bottom portions spanning the opposing side portions, wherein the splash bar extends in the lengthwise direction to define a splash bar length sufficient to rest on and between the spaced-apart horizontal hanger support members, wherein the top portion is generally upwardly arcuate in shape as viewed in cross-section, and wherein respective ones of the opposing side portions commencing at the bottom portion extend outwardly in the widthwise direction away from the heightwise and lengthwise axes and upwardly in the heightwise direction at an obtuse angle relative to the bottom portion to terminate at the top portion.

* * * * *